US011649814B2

(12) United States Patent
Giousouf et al.

(10) Patent No.: US 11,649,814 B2
(45) Date of Patent: May 16, 2023

(54) FLUID DEVICE

(71) Applicant: Festo SE & Co. KG, Esslingen (DE)

(72) Inventors: Metin Giousouf, Esslingen (DE); Gebhard Munz, Schorndorf (DE)

(73) Assignee: Festo SE & Co. KG, Esslingen (DE)

( * ) Notice: Subject to any disclaimer, the term of this patent is extended or adjusted under 35 U.S.C. 154(b) by 5 days.

(21) Appl. No.: 17/387,416

(22) Filed: Jul. 28, 2021

(65) Prior Publication Data

US 2022/0034310 A1 Feb. 3, 2022

(30) Foreign Application Priority Data

Jul. 30, 2020 (DE) ..... 102020209594.9

(51) Int. Cl.
*F04B 43/04* (2006.01)
*F04B 43/00* (2006.01)

(52) U.S. Cl.
CPC ..... *F04B 43/046* (2013.01); *F04B 43/0054* (2013.01)

(58) Field of Classification Search
CPC .. F04B 43/009; F04B 43/0009; F04B 43/046; F04B 43/0054; F16J 3/02
See application file for complete search history.

(56) References Cited

U.S. PATENT DOCUMENTS 3,606,592 A 9/1971 Madurski et al.
3,911,796 A * 10/1975 Hull ..... B60T 17/08 92/99
4,596,575 A * 6/1986 Rosenberg ..... F04B 43/046 128/DIG. 12
4,939,405 A * 7/1990 Okuyama ..... H01L 41/0973 310/317
4,944,028 A * 7/1990 Iijima ..... G01D 5/145 324/225

(Continued)

FOREIGN PATENT DOCUMENTS

DE 3881668 9/1993
DE 3881668 T2 9/1993

(Continued)

OTHER PUBLICATIONS

Definition of "resiliently" and "resilient" from Oxford Languages Dictionary (Year: 2022).*

*Primary Examiner* — Devon C Kramer
*Assistant Examiner* — Joseph S. Herrmann
(74) *Attorney, Agent, or Firm* — Hoffmann & Baron, LLP

(57) ABSTRACT

A fluid device including a fluid chamber which is designed for receiving a fluid and which is commonly delimited by a device housing and a bending-elastic membrane element. The membrane element with a peripheral edge section is fixed to the device housing in a fluid-tight manner and has a membrane working section which is framed by the peripheral edge section and which for the change of the volume of the fluid chamber can be elastically deflected by a piezoactuator. The membrane element consists of a rubber-elastic material, wherein the piezoactuator comprises a drive section which extends along the membrane working section, is embedded into the membrane element and is enveloped by the rubber-elastic material of the membrane element.

22 Claims, 4 Drawing Sheets

(56) References Cited

U.S. PATENT DOCUMENTS

| | | | | |
|---|---|---|---|---|
| 5,261,798 | A * | 11/1993 | Budde | F04B 9/135 417/393 |
| 5,852,589 | A | 12/1998 | Wilson et al. | |
| 6,262,519 | B1 * | 7/2001 | Furlani | H01L 41/0973 310/330 |
| 9,926,923 | B2 * | 3/2018 | Ito | F04B 43/02 |
| 2007/0035213 | A1 * | 2/2007 | Nakajima | F04B 43/046 310/348 |
| 2009/0232680 | A1 * | 9/2009 | Kitahara | F04B 43/046 417/413.2 |

FOREIGN PATENT DOCUMENTS

| | | | |
|---|---|---|---|
| DE | 19810657 | | 10/1998 |
| DE | 19810657 | A1 | 10/1998 |
| DE | 102013009592 | | 12/2014 |
| DE | 102013009592 | A1 | 12/2014 |
| JP | H03-12917 | | 1/1991 |
| JP | H03-12917 | A | 1/1991 |
| WO | 2012021412 | A1 | 2/2012 |
| WO | WO 2012021412 | | 2/2012 |

* cited by examiner

FLUID DEVICE

BACKGROUND OF THE INVENTION

The invention relates to a fluid device comprising a fluid chamber which is designed for receiving a fluid and which is commonly delimited by a device housing and a bending-elastic membrane element which has a planar extension in a main extension plane, wherein the membrane element at its peripheral edge section is fixed to the device housing in a fluid-tight manner and wherein a membrane working section of the membrane element which is framed by the peripheral edge section, for the change of the volume of the fluid chamber can be elastically deflected in a working direction which is orientated transversely to the main extension plane by a piezoactuator of the fluid device which acts upon the membrane element whilst carrying out a stroke movement.

A fluid device of the aforementioned type is known from JP-H03-12917 A, said device being applied on manufacturing semiconductors and providing the possibility of sucking back a fluid which is located in a fluid channel, in order to avoid an undesired dripping at a delivery output opening. The back-sucking effect can be created by way of an underpressure which can be generated in a fluid chamber of the fluid device, with which the fluid channel is in connection. The fluid chamber is commonly delimited by a device housing and by a membrane element which is fixed to the device housing at the edge side. The underpressure can be generated by way of a membrane working section of the membrane element which delimits the fluid chamber being deflected by way of a piezoactuator, so that the volume of the fluid chamber increases. The piezoactuator is designed as a stack translator and is fastened to one of the two membrane surfaces of the bending-elastic membrane element which are opposite one another. The piezoactuator has several electrodes, to which an operating voltage can be applied, by way of which a deformation of the piezoactuator is caused, such entailing a corresponding deformation of the membrane working section of the membrane element.

Concerning a back-suction valve which is known from DE 19810657 A1, an underpressure which effects the sucking-back of a fluid can be generated by way of a deformable membrane, on which a piston engages, said piston being biased by a spring and whose movement is controllable by the controlled fluid impingement of a further membrane.

SUMMARY OF THE INVENTION

It is the object of the invention to provide measures which permit a simple and precise change of the volume of the fluid chamber of a fluid device.

For achieving the aforementioned object, in a fluid device comprising the aforementioned features the membrane element consists of a rubber-elastic material, wherein the piezoactuator comprises a drive section which extends along the membrane working section, is embedded into the membrane element and is enveloped by the rubber-elastic material of the membrane element.

With regard to the fluid device according to the invention, the volume of a fluid chamber can be changed by way of a piezoactuator, by way of whose actuation a rubber-elastic membrane element which forms a movable delimitation wall of the fluid chamber is deformable. The piezoactuator has a drive section which by way of actuation of the piezoactuator is deformable and which transmits its deformation onto the adjacent membrane working section, so that this executes a stroke movement transversely to the main extension plane.

On account of the rubber-elasticity of the membrane element, the drive forces which are to be mustered by the drive section are relatively low, so that the piezoactuator can be operated in an energy-efficient manner Since the drive section of the piezoactuator extends in the inside of the membrane working section by way of it being embedded into the membrane element and being enveloped by the rubber-elastic material of the membrane element, the drive force can be reliably transmitted from the piezoactuator onto the membrane working section, combined with extremely compact dimensions.

An operating voltage of a variable magnitude can be applied to the piezoactuator, from which voltage a reversible shape change of the drive section results according to the inverse piezoelectric effect, said shape change being directly transmitted onto the membrane working section of the membrane element which envelops the drive section. By way of this, a clear assignment between the deflection of the drive section and the linear travel of the membrane working section is always ensured, which provides good preconditions for a volume change of the fluid chamber which can be closed-loop controlled in a precise manner. Depending on the degree of the deflection of the membrane working section which is created by the piezoactuator, the volume of the fluid chamber changes to a greater or lesser degree, wherein a volume enlargement can be used for example to generate an underpressure in the fluid chamber. The piezoactuator is preferably very simply controllable in a proportional manner, in order to be able to set different stroke positions of the membrane working section for specifying different volumes of the fluid chamber. The operation is possible with a low energy level, so that despite a direct control, no relevant intrinsic heating occurs. The piezoelectric concept further if necessary permits a closed-loop control of the position given the deflection of the membrane working section, so that accurately repeatable settings are possible. A reliable shielding of the piezoactuator from the fluid which is located in the fluid chamber can be achieved by the enveloping of the piezoactuator on the part of the membrane element, so that the functional capability of the piezoactuator cannot be compromised even with aggressive fluids.

Advantageous further developments of the invention are to be derived from the dependent claims.

In particular, an elastomer material is selected as a rubber-elastic material for the membrane element. Preferably, with regard to the elastomer material this is an NBR, (F)FKM, EPDM, silicone or thermoplastic elastomer.

The piezoactuator is fixed to the membrane element, in particular in a manner such that together with the membrane element it forms a subassembly which can be handled in a unitary manner. The piezoactuator and the membrane element are preferably immovable relative to one another. On assembly of the fluid device, the previously put-together subassembly can be unitarily inserted into the device housing, by which means a rational and inexpensive manufacture is possible.

The aforementioned subassembly can be manufactured in a particularly inexpensive manner by way of the drive section of the piezoactuator being peripherally overmoulded by injection moulding with the rubber-elastic material of the membrane element on manufacturing the membrane element. In this manner, a very intimate connection between the piezoactuator and the membrane element can be achieved. The two components can adhere to one another.

Alternatively, for example there is also the possibility of manufacturing the membrane element independently of the piezoactuator and of forming an elongate receiving recess in the inside of the membrane element independently of the piezoactuator, said receiving recess lying in the main extension plane and into which the piezoactuator is inserted with its drive section.

If according to the previously mentioned design the drive section of the piezoactuator is peripherally overmoulded with the rubber-elastic material of the membrane element, the receiving recess automatically results by way of the material of the membrane element clinging onto the outer periphery of the drive section of the piezoactuator.

The elongate receiving recess in particular is designed in the manner of a blind-hole and is open at one side in the region of the peripheral edge section of the membrane element. At the open side of the receiving recess, the piezoactuator can project out with a further length section which connects onto the drive section and which can be used in particular for the electrical contacting.

The membrane element is expediently designed in a plate-like manner.

It is seen as being favourable if the membrane element in the region of its peripheral edge section has a rectangular, elongate outer contour, so that it has an elongate shape which extends along an imaginary membrane longitudinal axis. The outer contour is expediently rounded at the corners. The drive section of the piezoactuator is expediently aligned parallel to the membrane longitudinal axis.

The membrane element as a separating wall is preferably arranged in the device housing in a manner such that it subdivides a housing interior of the device housing into the fluid chamber and a further housing chamber. In order for the stroke movement of the membrane working section not to be compromised by overpressure or underpressure which prevails in the further housing chamber, the further housing chamber is expediently constantly in connection with the surroundings via at least one breathing opening, so that the further housing chamber can be denoted as a breathing chamber. The at least one breathing opening in particular also prevents the adhering of the rubber-elastic membrane to the housing wall if the device housing is designed such that the membrane element bears on the housing wall in the non-deflected state of the membrane working section. This design is advantageous, in order to be able to realise dimensions of the device housing which are narrow in the working direction of the stroke movement.

A rear-side housing wall of the device housing which lies opposite the membrane element at the side which is opposite to the fluid chamber in the working direction, on its inner surface which faces the membrane element comprises a surface structure which consists of a field of numerous deepenings and prominences. A possible adhering of the membrane element to the device housing is also effectively prevented by way of this. The membrane element can be rear-vented over a large surface. Additionally or alternatively, a corresponding surface structure can be formed on the rear-side membrane surface of the membrane element which faces the housing rear wall, in order to interact with the housing rear wall.

The membrane element has a rear-side membrane surface which is away from the fluid chamber. Expediently, a groove arrangement is formed in this rear-side membrane surface on the longitudinal side next to the drive section of the piezoactuator. For example, a longitudinal groove extends along the drive section of the piezoactuator in the membrane element at both sides of the drive section. The groove arrangement ensures a high flexibility of the membrane element event given an otherwise relative large thickness of the membrane element which is selected in order for example to ensure a high stability of the membrane element even in the case of a relatively high fluid pressure.

The drive section of the piezoactuator expediently comprises an electrode arrangement, to which an operating voltage which causes the stroke movement of the membrane working section can be applied in a variable magnitude. A stroke position of the membrane working section and accordingly a desired volume of the fluid chamber can be set depending on the magnitude of the operating voltage.

The piezoactuator expediently comprises a piezoelectrically inactive carrier element which in the region of the drive section on at least one of its two longitudinal sides which face in the working direction is equipped with a piezoelement which has piezoelectric characteristics and which at its sides which are away from one another in the working directly is flanked by an electrode of the electrode arrangement. The piezoactuator can be designed for example as a bimorph or as a trimorph. On using an electrically conductive carrier layer, the carrier layer itself be directly used as an electrode. For example, a conductive carrier layer can consist of a carbon-fibre material.

In particular, trimorph piezoactuators provide the advantage of an active bending in both directions. If here too, it is mainly the bending in only one direction which is used in order to vary the volume of the fluid chamber, then it can occur that given a deactivated piezoactuator, this and thus also the membrane element does not exactly assume its completely non-deformed plane idle position due to typical hysteresis effects of the piezo laminate construction. In order to counteract the hysteresis and to guarantee the bringing of the membrane element into its plane surface alignment, the second piezoelement can be briefly activated with a suitable voltage level.

Above all, the realisation of a lamella-like longitudinal design is recommended for the piezoactuator. In particular, this is the case if the piezoactuator is designed as a piezo bending transducer, which is preferred.

The piezoactuator which is designed as a piezo bending transducer preferably has a drive section which for creating the stroke movement of the membrane working section can execute a deflection movement. The deflection movement, starting from an idle position which is present given a deactivated piezoactuator, can expediently be carried out in opposite directions, in order to be able to actively deflect the membrane working section in two directions which are opposite to one another.

In particular, the piezoactuator is designed and arranged such that in the region of the peripheral edge section of the membrane element it is supported in the working direction at two locations which are distanced to one another in the main extension plane of the membrane element, each by way of a rigid support structure of the device housing. The membrane working section which given an electrical activation of the piezoactuator bulges out in an arcuate manner extends between the two support structures. On account of this deformation behaviour, a volume change of the fluid chamber can be set in a particularly exact manner. The application of an operating voltage to the piezoactuator causes an extension of the piezo-material in the direction of the electric field, here therefore in the working direction, which leads to the piezoelement on the one hand becoming thicker and on the other hand simultaneously undergoing a reduction of its length. In combination with a piezoelectrically inactive carrier element which carries the piezoelement and does not participate in the deformation, this leads to the mentioned arcuate deformation of the drive section of the piezoactuator, which results in a corresponding deformation of the complete system consisting of the piezoelement and the membrane element.

Expediently, the membrane element in the region of the support structure comprises recesses, into which the support structures engage, by which means the membrane element is positively fixed relative to the device housing in the main extension plane. In particular, this is advantageous if the membrane element at its peripheral end section is only fixed to the drive housing in a non-positive and/or material manner, for example by way of clamping and/or a bonding connection.

In particular, the piezoactuator is designed such that it comprises a base section which connects axially onto the drive section and which in a freely ending manner projects out of the membrane element. This base section can be used for the electrical contacting of the piezoactuator. Concerning the stroke movement of the membrane working section, the base section expediently executes a pivoting movement, whose movement direction is opposite to the momentary stroke movement of the membrane working section.

Concerning a particularly advantageous embodiment, the fluid device is provided with a position detection device which is designed for the detection of a relative position which changes given the stroke movement of the membrane working section between the piezoactuator and the device housing. The position detection device permits a particularly precise and always reproducible setting of the volume which is desired of the fluid chamber. Since the stroke position of the membrane working section has an effect upon the volume of the fluid chamber, wherein in particular a proportional dependency is present, a reliable volume setting can be carried out on account of the determined position values. Different measuring principles, for whose implementation the position detection device is designed, are considered for the position detection. For example capacitive or inductive position detection is possible.

It is seen as being particularly expedient if the position detection device comprises two detection components which cooperate with one another, in the design of a permanent magnet, and a sensor which can be actuated by the permanent magnet, wherein the one of these two detection components is arranged on the base section of the piezoactuator which carries out a pivoting movement given the stroke movement of the membrane working section and the other detection component is arranged in a stationary manner with respect to the device housing. The sensor which is designed for example as a Hall sensor is seated on the device housing, whereas the permanent magnet is attached to the base section of the piezoactuator. The sensor can be attached directly to the device housing or to an additional component, for example a circuit board, which is fixed to the device housing.

The fluid device preferably comprises an electronic control device which is electrically connected onto the piezoactuator on operation of the fluid device and by way of which an operating voltage can be specified in a certain magnitude, in order to be able to set at least one stroke position of the membrane working section which is assumed with respect to the device housing. The electronic control device in particular is designed in order to effect a charge feed or charge discharge with respect to an electrode arrangement of the piezoactuator in accordance with requirements. For example, the electronic control device comprises a high voltage stage. Depending on the magnitude of the applied operating voltage, a stroke movement of the membrane working section and a positioning of the membrane working section in a defined stroke position can be effected with the help of the control device, wherein the set stroke position each corresponds to a certain volume of the fluid chamber.

It is particularly favourable if the electronic control device is designed for a closed-loop controlled setting of the stroke position of the membrane working section, wherein the closed-loop control is effected on the basis of the position measurement values which are determined by the position detection device. A closed-loop control of the volume of the fluid chamber is effected in an indirect manner by the closed-loop control of the position, since the piezoactuator has a reproducible deformation behaviour, and thus an unambiguous assignment between the individual stroke positions of the membrane working section and the momentary volume of the fluid chamber exists.

The fluid device can be applied in arbitrary situations, in which it is a case of setting the volume of a fluid chamber in accordance with requirements. For example, a volume setting can be effected in order to specify a fluid volume which is relevant to a subsequent metering procedure, this for example being in the fields of semiconductor industry or laboratory automation.

A particularly advantageous use for the fluid device lies in its application as a fluid suction device, wherein an underpressure can be created by a volume increase of the fluid chamber which is caused by way of the piezoactuator, by way of which underpressure fluid which is located in the fluid channel which is connected to the fluid chamber can be sucked into the fluid chamber. By way of this, for example a post-dripping of liquid in the case of metering procedures can be prevented. Metering procedures are commonplace in many fields, such as for example in medical technology or also with industrial applications and for example in circuit board manufacture on metering a photo resist onto circuit boards or wafers for semiconductor manufacture.

A particularly expedient fluid device has two fluid channels which communicate with the fluid chamber, wherein a first fluid channel is an exit channel, through which fluid which is located in the fluid chamber can flow out of the fluid chamber, whilst a second fluid channel is an entry channel, through which fluid can flow into the fluid chamber. A shut-off unit which is assigned to the second fluid channel can selectively release or block the second fluid channel, in order to permit or prevent a passage of fluid. Such a shut-off unit represents for example a metering valve if the fluid device is used as a metering device or as a constituent of a metering device. In order, after completion of a metering procedure, to prevent a post-dripping of liquid fluid, the piezoactuator is held in an operational state during the metering, with which operational state the fluid volume of the fluid chamber is reduced. After stopping the metering procedure, the fluid volume is enlarged by way of a suitable control of the piezoactuator, so that a desired quantity of fluid is sucked back out of the exit channel into the fluid chamber.

BRIEF DESCRIPTION OF THE DRAWINGS

The invention is hereinafter explained in more detail by way of the accompanying drawings. There are shown in.

DETAILED DESCRIPTION

Figure 1:
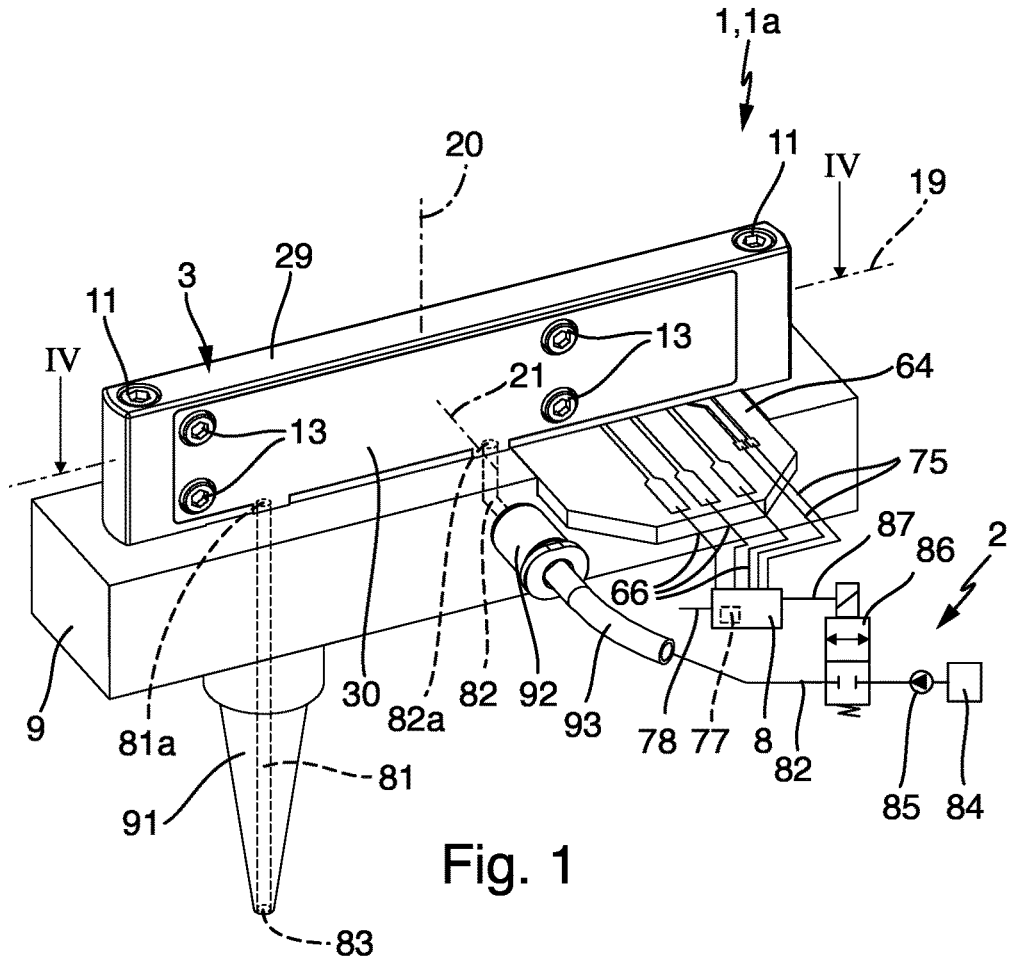
FIG. 1 a perspective representation of a preferred design of the fluid device according to the invention, in the context of a metering device, FIG. 2 the arrangement of FIG. 1 from a different viewing angle and in a partially cut-open state of a device housing of the fluid device, FIG. 3 an isometric exploded representation of the arrangement according to FIGS. 1 and 2, FIG. 4 a longitudinal section according to section line IV-IV of FIGS. 1, 6 and 7, in which the membrane working section assumes an non-deflected home position, so that the fluid chamber has a maximal volume, wherein a channel plate which is evident in FIGS. 1 to 3 is not represented, FIG. 5 a further longitudinal section in the same section plane as FIG. 4, wherein the membrane working section is shown on assuming a deflected operational position, so that the fluid chamber has a reduced volume, FIG. 6 a cross section according to section line VI-VI of FIG. 4, FIG. 7 a cross section according to section line VII-VII of FIG. 4, FIG. 8 an individual representation of a subassembly which can be unitarily handled, comprising the membrane element and the assigned piezoactuator of the fluid device of FIGS. 1 to 7 in a viewing direction from the side of the fluid chamber, and FIG. 9 a further illustration of the subassembly according to FIG. 8 in a rear view with a view upon the rear side which is away from the fluid chamber.
Figure 2:
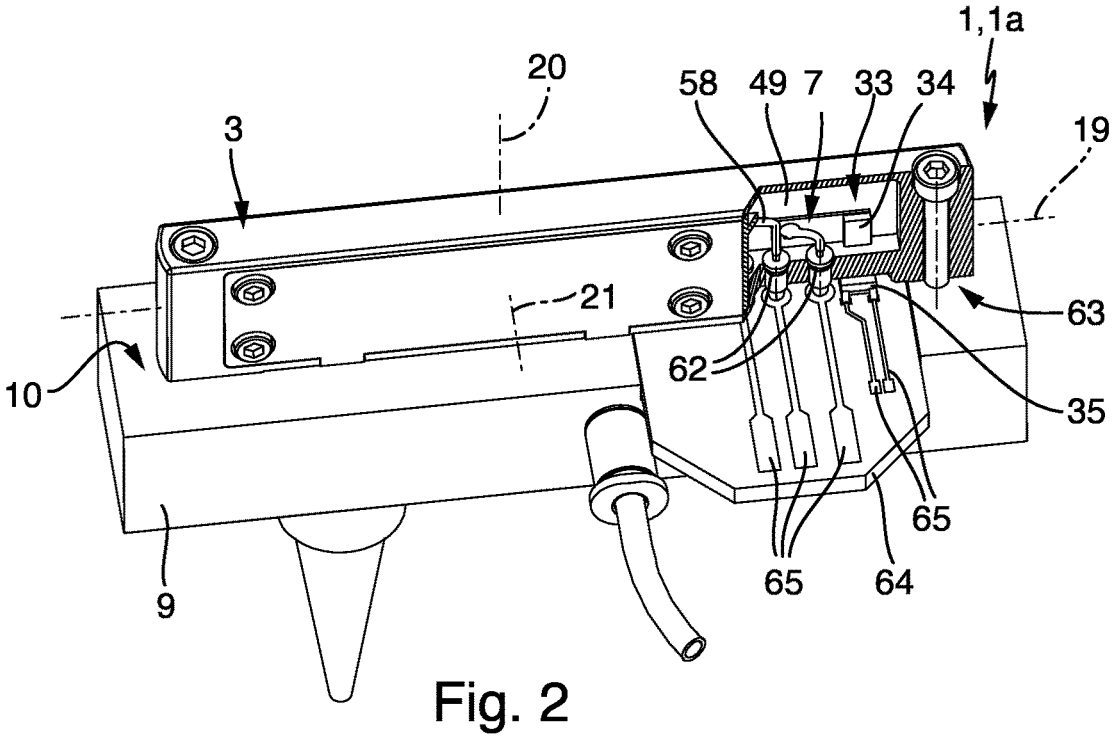

A fluid device which in its entirety is provided with the reference numeral 1 is evident from the drawing, said fluid device being shown in a preferred design and application as a fluid suction device 1*a* and herein in the scope of an advantageous integration into a metering device 2 for fluid media.

Essential constituents of the fluid device 1 are expediently grouped together in a device unit 12 which can be realised in compact dimensions. The device unit 12 is preferably fastened to the channel plate 9 in a releasable manner. The channel plate 9 has a carrier surface 10, on which the device unit 12 is assembled. By way of example, the device unit 12 is clamped to the carrier surface 10 by way of fastening screws 11 which pass through it and which are screwed into the channel plate 9. The channel plate 9 is not shown in FIGS. 4 to 9.

The fluid device 1 has a device housing 3. With regard to the illustrated embodiment example, the device housing is a housing of the device unit 12 which is designed in a separate manner with respect to the channel plate 9. However, constructional shapes of the fluid device 1 concerning which a physical subdivision into a device unit 12 and a channel plate 9 is not present are also possible, so that the channel plate 9 is an integral constituent of the device housing 3.

The fluid device 1 comprises a bending-elastic membrane element 4 which by way of example is a constituent of the device unit 12 and is thus combined with the device housing 3 such that together with the device housing it delimits a chamber 5 which on operation of the fluid device 1 receives fluid and is therefore denoted as a fluid chamber 5 for a better differentiation.

A piezoelectric actuator of the fluid device 1 which is denoted as a piezoactuator 7 is assigned to the membrane element 4. For the actuation of the piezoactuator 7, the fluid device 1 expediently comprises an electronic control device 8 which is only indicated schematically and which by way of example is arranged away from the device unit 12.

The device housing 3 has a longitudinal axis 19, a height axis 20 which is at right angles thereto and a transverse axis 21 which is at right angles to the two aforementioned axes 19, 20. The device housing 3 has a longitudinal design, wherein it has larger dimensions in the axis direction of the longitudinal axis 19 than in the axis directions of the height axis 20 and the transverse axis 21. The dimensions in the axis direction of the transverse axis 21 are preferably lower than the dimensions in the axis direction of the height axis 20, so that the device housing 3 has a narrow ledge-like shape. However, the device housing 3 can also be realised in other proportions.

The axis directions of the longitudinal axis 19, the height axis 20 and the transverse axis 21 are hereinafter also defined as the length direction 10, the height direction 20 and the transverse direction 21 for a simple denotation whilst using identical reference numerals.

The device housing 3 encompasses a housing interior 14. The membrane element 4 as well as the piezoactuator 7 is located in the housing interior 14.

The membrane element 4 preferably has a plate-like design. At its narrow side, it preferably has a rectangular, elongate outer contour 18. The four corner regions in particular are rounded. The membrane element 4 is thus arranged in the housing interior such that a membrane longitudinal axis 6 which runs in the longitudinal direction of the membrane element 4 runs parallel to the longitudinal axis 19 of the device housing 3.

The membrane element 4 extends planarly in a main extension plane 15. The membrane element 4 is preferably arranged in the housing interior 14 such that the direction of the normal to the main extension plate 15 coincides with the transverse direction 21.

The outer contour 18 is defined by the peripheral course of a peripheral edge section 17 of the membrane element 4.

At its peripheral edge section 17, the membrane element 4 is fixed to the device housing 3 in a fluid-tight manner. For this, by way of example it is clamped at its peripheral edge section 17 between two first and second housing parts 29, 30 of the device housing 2 which are opposed to one another in the transverse direction 21. The sealing results from the fact that the membrane element 4 consists of a rubber-elastic material which is elastically pressed together by way of the clamping in the region of the peripheral edge section 17.

The rubber-elastic material of the membrane element 4 is preferably an elastomer material.

Since the membrane element 4 as a whole is designed in a fluid-tight manner, it subdivides the housing interior 14 into two part-spaces amid sealing, of which part-spaces the one forms the fluid chamber 5 and the other by way of example has no further function but for ensuring an unhindered movability of the membrane element 4 constantly communicates with the atmosphere and is therefore denoted as a breathing chamber 25 for an improved differentiation. On the part of the device housing 3, the breathing chamber 25 is delimited by a housing rear wall 26 which is designed as a constituent of the first housing part 29 and which lies opposite a rear-side membrane surface 39 of the membrane element 4 and through which one or more breathing openings 16 pass, said breathing openings permitting a continuous air exchange with the atmosphere which surrounds the device housing 3.

The two housing parts 29, 30 by way of example are screwed to one another by way of fastening screws 13, but can also be fastened to one another in a different manner.

By way of example, the first housing part 29 has a recess 41 which at the rear side is delimited by the housing wall 26 and at its open front side is closed by the second housing part 30. The second housing part 30 forms a housing front wall 22 which delimits the fluid chamber 5 at a front side which lies opposite the membrane element 4 in the transverse direction 21. The second housing part 30 is expediently conceived as a cover which immerses into the recess 41 and bears on a support surface 41*a* of the first housing part 29 which is formed by a shouldering of the inner contour the recess 41.

An account of the rubber-elasticity of the membrane element 4, a membrane section which is framed by the peripheral edge section 17 and which for an improved differentiation is denoted as a membrane working section 27 is reversibly bendable or deflectable in a direction which is at right angles to the main extension plane 5, thus by way of example in the transverse direction 21. The deflection movement or bending movement which takes place with such a procedure is hereinafter denoted as the stroke movement 28 and is illustrated by a double arrow.

Figure 4:
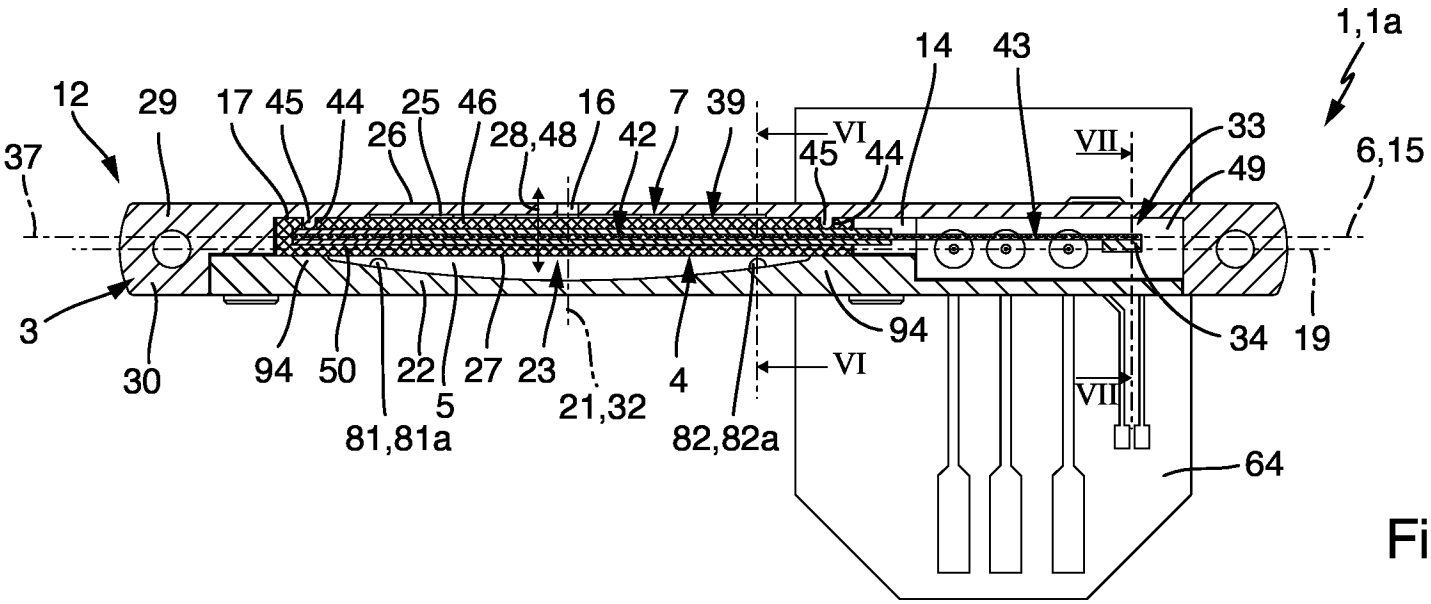

The membrane working section 27 is shown in an operational position in FIG. 4, with regard to which it is a non-deflected home position. Here, the membrane element 4 completely extends in the main extension plane 15. The membrane element 4 is preferably subjected to no mechanical biasing in the non-deflected home position of the membrane working section 27.

Figure 5:
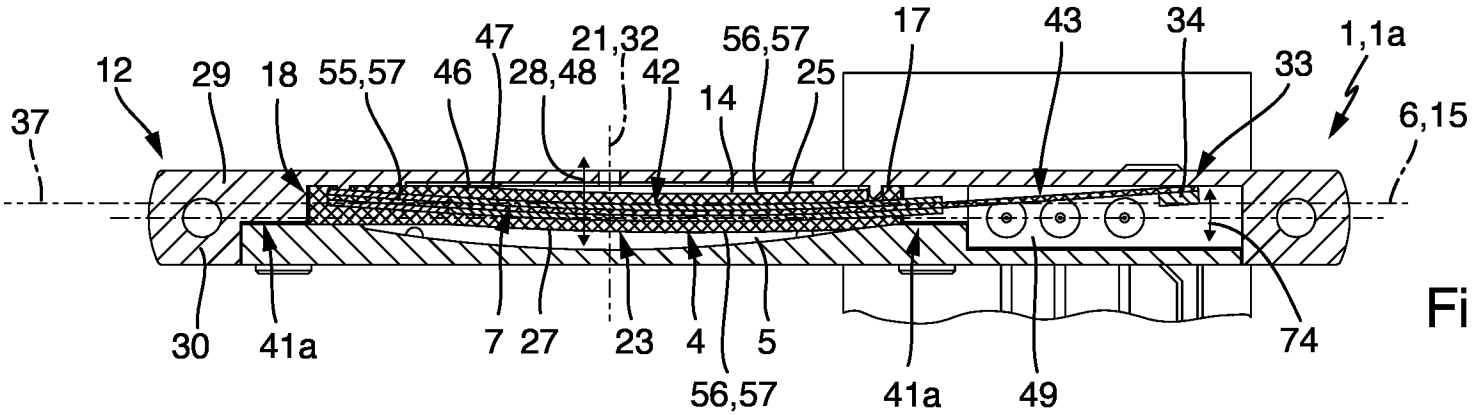
Figure 6:
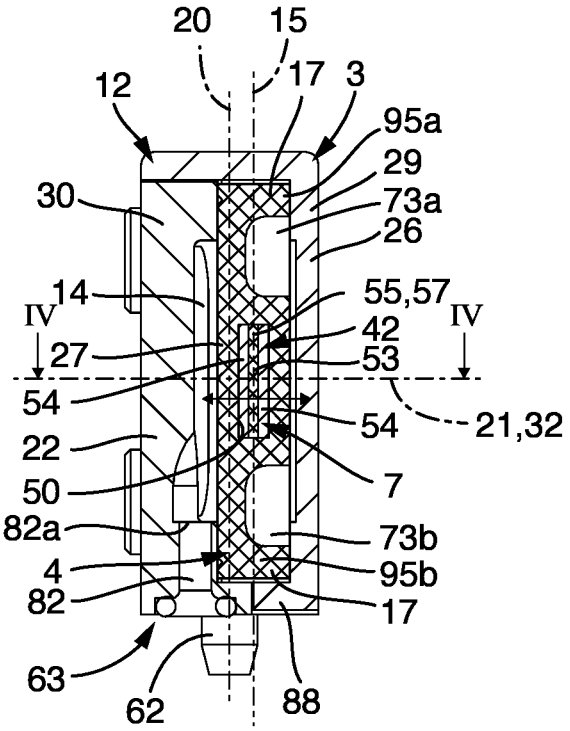
Figure 7:
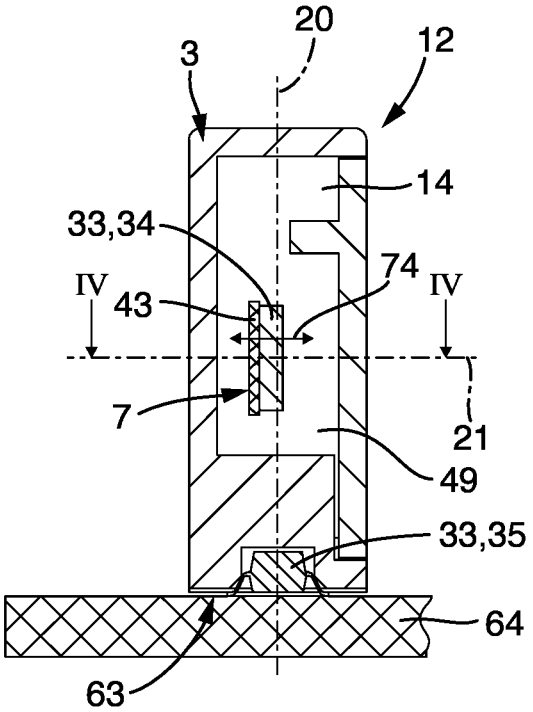
Figure 8:
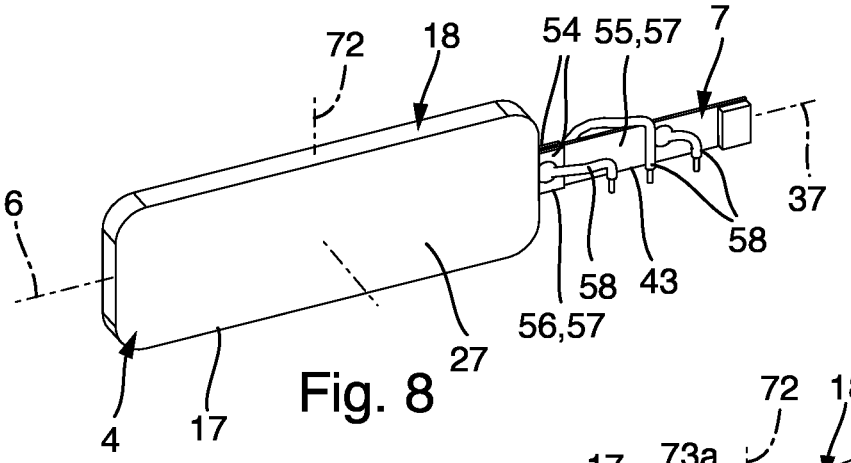
Figure 9:
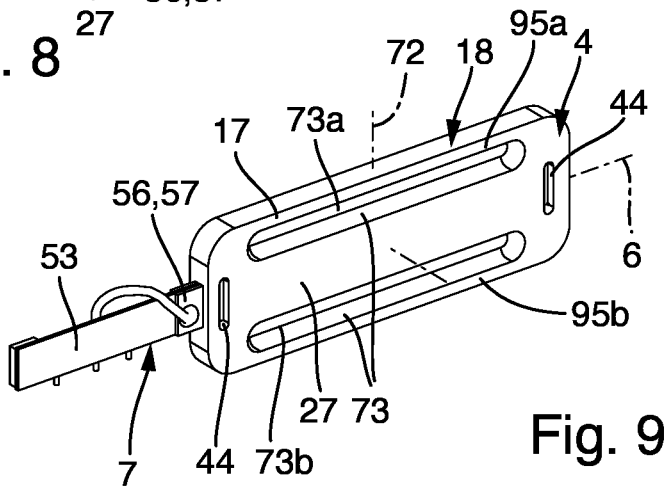

An operational position of the membrane working section 27 which is deflected in the transverse direction 21 with respect to the home position is evident from FIG. 5. The membrane working section 27 is hereby distanced at least regionally to the imaginary main extension plane 15 which passes through the peripheral edge section 17, wherein the distance is greatest in a surface-central region 23 and starting from there gradually decreases towards the peripheral end section 17 in the longitudinal direction 19.

The membrane working section 27 can be assume operational positions which are deflected to a different extent and which differ from one another in their distance which is present with respect to the main extension plane 15.

The direction of the stroke movement 28 which by way of example coincides with the transverse direction 21 is hereinafter also denoted as the working direction 32 and is rendered recognisable by a dot-dashed line. Positions of the membrane working section 27 which can be achieved in the course of the stroke movement 28 are hereinafter also denoted as stroke positions of the membrane working section 27.

The volume of the fluid chamber 5 depends on the momentary stroke position of the membrane working section 27. The further the membrane working section 27 is deflected in the direction towards the housing front wall 22, the smaller is the fluid chamber volume.

The operating states of the fluid device 1 which are shown in FIGS. 4 and 5, in FIG. 4 define a maximal volume and in FIG. 5 a minimal volume of the fluid chamber 5.

The stroke movement 28 of the membrane working section 27 can be created by the piezoactuator 7. Different stroke positions of the membrane working section 27 can be set by the piezoactuator 7, either in a stepwise manner or preferably stepless manner. Each set stroke position can be retained for as long as desired.

According to the illustrated embodiment example, the piezoelectric actuator 7 is preferably designed as a piezo bending transducer. In particular, it has a longitudinal extension with a lamella-like design, as is quite evident from FIG. 3. The piezoactuator 7 is arranged in the housing interior 14 in a manner such that its longitudinal axis 37 runs parallel to the longitudinal axis 19 of the device housing and further expediently in the non-deflected home position of the membrane element 4 runs parallel to the main extension plane 15.

A front length section of the piezoactuator 7 forms a drive section 42 which for generating the stroke movement 28 acts upon the membrane working section 27. A rear length section of the piezoactuator 7 which is denoted as a base section 43 and which by way of example is used for the electrical contacting of the piezoactuator 7 connects onto this drive section 42 in the longitudinal direction 37.

The drive section 42 extends in the inside of the membrane element 4 along the membrane working section 27. This is realised by way of the drive section 42 being embedded into the membrane element 4 and being enveloped by the rubber-elastic material of the membrane element 4.

Expediently, the drive section 42 is encompassed completely all around by the membrane element 4 with the exception optionally of two locations in the region of the peripheral edge section 18, said regions being distanced to one another in the longitudinal direction 37 and being where the membrane element 4 expediently each has a fixation recess 44, into which a support structure 45 which is formed on the device housing 3 engages. The fixation recesses 44 by way of example are located in the rear-side membrane section 46 which lies between the drive section 42 and the housing rear wall 26, whilst the support structures 45 are formed on the inner surface 47 of the housing rear wall 26 which face the membrane element 4. Each support structure 45 is preferably designed as a projection, wherein it is particularly a rib-like projection which extends parallel to the height axis 20. Hereby, each fixation recess 44 is then expediently designed with the shape of a longitudinal slot.

By way of the engagement of the support structures 45 into the fixation recesses 44, the membrane element 4 additionally to the edge-side clamping is positively prevented from a relative movement relative to the device housing 3 in the longitudinal direction 19. By way of this, the membrane element 4 reliably retains the desired position within the device housing 3.

The support structures 45 preferably extend through the rear-side membrane section 46 up to the drive section 42, so that this is supported in a direct manner at one side by way of the device housing 3 at two locations which are distanced to one another in the longitudinal direction 37. On the side which lie opposite the support structures 45 in the transverse direction 21, expediently no direct housing-side support of the drive section 42 is effected and here the fixation is limited to the clamping of the peripheral edge section 17.

Differing from the embodiment example, the support structures 45 could be formed on the housing front wall 22 instead of on the housing rear wall 26.

Given the electrical actuation of the piezoactuator 7, its drive section 42 bends in the transverse direction 21 in the region which lies between the two support structures 45. This procedure is denoted as the deflection movement 48 of the drive section 42. Given the deflection movement 48, the distance between the drive section 42 and the housing front wall 22 changes. Since the drive section 42 is encompassed by the membrane working section 27 of the membrane element 4, the membrane working section 27 participates in the deflection movement 48, from which the stroke movement 28 of the membrane drive section 27 which is orientated in the same direction results.

In the electrically deactivated state, when the piezoactuator 7 is discharged, the drive section 42 assumes a non-deflected idle position. The deflection movement 48 can be created by way of electrical actuation. The deflection movement 48, starting from the idle position, can expediently be created in the transverse direction 27 in one of two opposite directions, in order to be able to actively deflect the membrane working section 27 in two directions which are opposite to one another.

The membrane element 4 extends in the inside of the device housing 3 only along a part length of the housing interior. A further part-space of the housing interior 14 connects onto the membrane element 4 in the longitudinal direction 19, said part-space hereinafter being denoted as the contacting chamber 49 for a better differentiation, since the electrical contacting of the piezoactuator 7 is effected in it.

A receiving recess 50 which is designed in manner of a blind hole and is merely open at one side, specifically in a region of the outer contour 18 of the membrane element 4 which faces the contacting chamber 49, is formed in the membrane element 4. There, the piezoactuator 7 projects with its base section 43 out of the membrane element 4 and into the contacting chamber 49. The drive section 42 of the piezoactuator 7 extends within the receiving recess 50.

The piezoactuator 7 with its drive section 42 is preferably fixed into the receiving recess 50 in a manner such that the membrane element 4 and the piezoactuator 7 are immovable relative to one another and form a componentry which is held together in a fixed manner and which on assembly of the fluid device 1 can be inserted as a unit into the device housing 3.

For example, the piezoactuator 7 is inserted and in particular pressed into the premanufactured receiving recess 50. Another realisation form envisages the membrane element being integrally formed around the drive section 42 with the injection moulding manufacture, so that the drive section 42 is peripherally overmoulded by the material of the membrane element 4.

The base section 43 in the contacting chamber is not mechanically connected to the device housing 3 with the exception of the electrical contacting measures. It projects in a freely ending manner into the contacting chamber 49, so that it can execute a relative movement with respect to the device housing 3 in the transverse direction 21.

The piezoactuator 7 comprises a strip-like carrier element 53 which extends in the longitudinal direction 37 and which is piezoelectrically inactive and thus has no piezoelectric characteristics. The carrier element 53 extends over the entire length of the piezoactuator 7.

In the region of the drive section 42, the carrier element 53 at its opposite longitudinal sides which point in the working direction 28 are each occupied by a plate-like piezoelement which has piezoelectrically characteristics. The piezoelements 54 are fixedly connected and in particular bonded to the carrier element. Each piezoelement 54 consists of a piezoelectric material, in particular a piezeoceramic.

Each piezoelement 54 at its sides which are way from one another in the working direction 28 is flanked by an electrode 55, 56 which for the improved differentiation are denoted as the first electrode 55 and the second electrode 56. All electrodes 55, 56 together form an electrode arrangement 57 of the piezoactuator 7.

It is advantageous if according to the embodiment example the carrier element 53 comprises electrically conductive characteristics and directly assumes the function of the first electrode 55 for both piezoelements 54. The second electrode 56 expediently consists of an electrically conductive coating of the piezoelement 54 which is deposited for example as a metallisation.

On account of the embedding of the drive section 42, the piezoelement 54 does not come into contact with the fluid which is located in the fluid chamber 5, which ensures an operation with minimal interruption.

Electrical leads 58 which in the operatically ready state of the fluid device 1 are connected to the electronic control device 8 are connected in the contacting chamber 49 to the electrode arrangement 57. Specifically, the electrical leads 58 are connected to several, in particular resiliently designed connection contacts 62 which are fixed in the device housing 3 in the region of a lower side 63, said lower side facing the carrier surface 10, and are led out of said device housing. A circuit board 64 which is provided with strip conductors 65, with which the connection contacts 62 are electrically contacted in the state of the device unit 12 being assembled on the carrier surface 10 is seated in a deepening of the carrier surface 10. These strip conductors 65 are in electrical connection with the electronic control device 8 in a preferably releasable manner via arbitrarily designed electrical leads 66.

The electronic control device 8 is designed in order to provide an electrical operating voltage of a variable magnitude which can be applied to the electrode arrangement 57 via the electrical leads 66. The control device 8 has its own device, in order to permit the charge feed and charge discharge with respect to the electrodes 55, 56, such being necessary for the variable control.

FIG. 4 illustrates the operating state, concerning which the operating voltage is equal to zero, so that the drive section 42 assumes the non-deflected home position. In contrast to this, FIG. 5 shows an operating state with an operating voltage of larger than zero, concerning which the drive section 42 is deflected with an arcuate shape amid the reduction of the volume of the fluid chamber 5. The movement of the drive section 42 between different operating states is effected in the course of the deflection movement 48. The stroke movement 28 of the membrane working section 27 is always entailed by this deflection movement 48.

On account of the exemplarily present trimorph construction type, with regard to the exemplary piezoactuator 7 the deflection movement 48 can be actively created in both directions. Concerning an embodiment example which is not illustrated, the piezoactuator 7 is of a monomorphous or bimorphous type, so that an active deflection is only effected in one direction, whilst the restoring is created by way of the inherent spring elasticity.

The control of the piezoactuator on both sides is preferred, in order by way of an activated counter piezolayer to compensate remains of deformations given a discharged piezoactuator, such deformations being caused by hysteresis.

In all cases, the volume which is enclosed in the fluid chamber 5 can be variably set by way of a suitable control of the piezoactuator 7.

The fluid device 1 can be operated with every arbitrary fluid. The preferred application is effected with a liquid, but nonetheless a gaseous fluid for example pressurised air can also be used.

It is advantageous if the device housing 3 is designed such that the membrane working section 27 bears on the housing rear wall 26 in the non-deflected home position. The volume of the breathing chamber 25 is therefore at least almost equal to zero in the non-deflected home position. This permits a design of the device housing 3 with very small dimensions in the transverse direction 21.

In order to prevent the membrane element 4 which for example consists of silicone material from sticking to the housing rear wall 26 at the inside, the housing rear wall 26 on its inner surface 47 which faces the membrane element 4 is expediently provided with a surface structure 68 which consist of a multitude of deepenings and prominences. In combination with the at least one breathing opening 16, thus a continuous rear-venting of the membrane working section 7 is given, such counteracting the adhering.

A surface structure 68 with a multitude of prominences and deepenings which lie therebetween can alternatively or additionally be formed on the rear-side membrane surface 39 which faces the inner surface 47.

The membrane element 4 has an imaginary membrane transverse axis 72 which is at right angles to the membrane longitudinal axis 6 and which runs parallel to the height axis 20 of the device housing 3. The piezoactuator 7 is preferably arranged such that its membrane working section 27 runs in the axis direction of the membrane transverse axis 72 centrally in the membrane element 4 and thus has an equally large distance to the two longitudinal sides 95*a*, 95*b* of the membrane element 4.

In order to be able to encompass the drive section 42 all around, a certain thickness of the membrane element 4 at right angles to the main extension plane 15 is necessary. In order despite this to obtain a very good rubber-elastic deformation capability for the membrane working section 27, it is advantageous if the membrane element 4 on its rear-side membrane surface 39 is provided with a groove arrangement 73 which reduces the wall thickness. The groove arrangement 73 expediently extends on both sides of the drive section 42 in the axis direction of the membrane longitudinal axis 6. By way of example, the groove arrangement 73 comprises two longitudinal grooves 73*a*, 73*b* which flank the drive section 42 on opposite longitudinal sides.

Since the base section 43 receives no support within the contacting chamber 49, given the stroke movement 28 of the membrane drive section 27 which is created by the piezoactuator, it executes a pivoting movement 74 relative to the device housing 3, said pivoting unit being indicated by the double arrow and specifically being in a the same plane, in which the deflection movement 48 also take space.

The fluid device 1 is preferably provided with a position detection device 33 which is provided for detecting the current pivoting position of the base section 43. Since the pivoting position of the base section 43 is directly dependent on the stroke position of the drive section 42, the measured pivoting position permits precise information on the momentary volume of the fluid chamber 5. Furthermore, by way of a targeted setting of the pivoting position, a volume of the fluid chamber 5 which is desired for a certain application case can be set.

The position measurement values which are determined by the position detection device 33, in the case of the illustrated embodiment example are fed to the electronic control device 8 which is capable of carrying out a closed-loop controlled setting of the stroke position of the membrane working section 27 and thus indirectly also of the volume of the fluid chamber 5, on the basis of the position measurement values as the actual values. The position detection device 33 is connected onto the electronic control device 8 via electrical leads. These electrical leads 75 are connected to the position detection device 33 via strip conductors 65 of the circuit board 64.

The position detection device 33 is expediently integrated at least partly into the device unit 12.

By way of example, the position detection device 33 comprises two first and second detection components 34, 35 which cooperate with one another in a contactless manner and which given the pivoting movement 74 of the base section 43 carry out a relative movement to one another. Whereas the first detection component 34 is arranged on the base section 43 and thus participates in its pivoting movement 74, the second detection component 35 is arranged in a stationary manner with respect to the device housing 3. By way of example, the second detection component 35 is situated outside the device housing 3, wherein it is expediently seated on the circuit board 64. By way of example, the second detection component 35 is situated in the region of the lower side 63 of the device housing 3 which extends past the circuit board 64 which is equipped with the second detection component 35.

The first detection component 34 is expediently arranged at the free end region of the base section 43, so that given the deflection movement 48 it covers a relatively large pivoting path which benefits a precise position detection.

It is to be understood that the two detection components 34, 35 can just as well both be arranged within the device housing 3 and in particular in the contacting chamber 49.

Concerning the illustrated embodiment example, the first detection component 34 is formed by a permanent magnet and the second detection component 35 by a sensor, in particular a Hall sensor, which responds to the magnetic field of the permanent magnet. This arrangement can also be exchanged. Likewise, other contact-free measuring principles can also be applied for the position detection, for example inductively, capacitively or optically.

The electronic control device 8 expediently comprises an internal closed-loop control unit 77 for carrying out the closed-loop control measures which are described further above.

The electronic control device 8 is further expediently provided with input means 78 via which at least one setpoint of the pivoting position of the base section 43 which is to be set, or of the volume of the fluid chamber 5 which is to be set, can be inputted. This setpoint in the closed-loop control unit 77 is compared to the actual values which are determined by the position detection device 33, in order to output an operating voltage to the electrode arrangement 57 via the electrical leads 66 in dependence on the results of the comparison, by way of which operating voltage the piezoactuator 7 is deformed such that the pivoting position of the base section 43 and thus the volume of the fluid chamber 5 is set to the desired setpoint.

Concerning the exemplary fluid device 1, for this reason there is the advantageous possibility of deforming the membrane working section 27 in a manner closed-loop controlled with regard to the distance and accordingly of indirectly also carrying out a closed-loop control of the volume which is defined by the fluid chamber 5.

In the illustrated exemplary design as a fluid suction device 1*a*, a first fluid channel 81 and a second fluid channel 82 are connected to the fluid chamber 5, of which by way of example the first fluid channel 81 forms an exit channel and the second fluid channel 82 an entry channel.

The first fluid channel 81 leads to a delivery opening 83, at which a desired fluid quantity can be delivered. On using the fluid suction device 1*a*, the fluid chamber 5 and the first fluid channel 81 are normally completely filled with fluid.

The second fluid channel 82 leads to a fluid source 84, concerning which it is for example a fluid reservoir, for example a liquid reservoir.

A delivery pump 85 is preferably connected into the course of the second fluid channel 82 and is capable of feeding fluid which is provided by the fluid source 84, through the second fluid channel 82 into the fluid chamber 5.

Preferably, a shut-off unit 86 is arranged in the course of the second fluid channel 82 in the channel section between the fluid chamber 5 and the delivery pump 85, concerning which shut off unit by way of example it is a shut-off valve which in particular has a 2/2-way valve function. The shut-off unit 86 is expediently connected onto the electronic control device 8 via an electrical control lead 87 and can be actuated by way of this according to requirements. By way of example, the shut-off unit 86 can be selectively switched into a shut-off position which is evident from FIG. 1 or into an open position. A fluid passage through the second fluid channel 82 is possible in the open position, whereas the second fluid channel 82 is blocked in the shut-off position of the second fluid channel 82, in order to prevent a flow of fluid into the fluid chamber 5.

Concerning a preferred operating manner of the fluid suction device 1*a*, the shut-off unit 86 in a first operating phase is switched into the open position, wherein the delivery pump 85 which is in operation delivers a fluid out of the fluid source 84 through the second fluid channel 82, the fluid chamber 5 and the first fluid channel 81 to the delivery opening 83. The fluid exits at the delivery opening 83 for the designated use.

The fluid transport and the fluid delivery take place until the shut-off unit 86 is switched over into the shut-off position by the control device 8. Here, the fluid flow and the fluid delivery at the delivery opening 83 are then stopped.

Evidently, a metered fluid delivery at the delivery opening 83 can be effected during the time intervals which are selected between the open position and the shut-off position of the shut-off unit 86. Inasmuch as this is concerned, the fluid suction device 1*a* can be advantageously used in a metering device 2 according to the illustrated embodiment example.

The changeability of the volume of the fluid chamber 5 in the case of the outlined metering application can be used in the second operating phase which is evident in FIG. 1, to prevent a subsequent undesired dripping-out of fluid at the delivery opening 83. For this, the volume of the fluid chamber 5 can be enlarged after the switching-over of the shut-off unit 86 into the shut-off position by way of a corresponding actuation of the piezoactuator 7, so that a underpressure arises in the fluid chamber 5, such resulting in fluid which is situated in the first fluid channel 81 being sucked back into the fluid chamber 5. By way of this, the fluid column which is located in the first fluid channel 81 is drawn back and an intermediate space which is filled with air and which prevents a fluid exit forms between this fluid column and the delivery opening 83.

The exemplary fluid suction device 1*a* in particular can be used to the extent that the piezoactuator 7 during a first operating phase, in which the shut-off unit assumes the open position, is activated by way of applying an operating voltage such that the membrane working section 27 is deflected in the direction of the fluid chamber 5 and the fluid chamber 5 is set to a reduced chamber volume. This corresponds to the operating state which is shown in FIG. 5. In order to generate the desired underpressure, in a second operating phase according to FIG. 4 the operating voltage is reduced for the piezoactuator 7 or the piezoactuator 7 is discharged, so that the membrane working section 27 is moved somewhat in the direction of the non-deflected home position according to FIG. 4 or completely returns into this non-deflected home position which entails an increase of the volume of the fluid chamber 5 which causes a underpressure and entails the previously outlined fluid back-sucking effect.

The desired volume of the fluid chamber 56 or the desired volume change can be set and specified in a very precise manner with the help of the electronic control device 8. In this manner, one can specify in a very exact manner the quantity of fluid which is to be sucked back.

The fluid suction device 1*a* by way of example can be used in the context of a metering device 2 which is used to apply the necessary photoresist on semiconductor manufacture. Another possible application is for example is a metered delivery of liquid into the cavities of micro titration plates in laboratory application.

The two fluid channels 81, 82 run out with channel mouths 81*a*, 82*a* which are separate from one another, into the fluid chamber 5 independently of one another. These channel mouths 81*a*, 82*a* by way of example are formed on a lower housing wall 88 which delimits the fluid chamber 5 at the lower side 63 and through which longitudinal sections of the first and second fluid channels 81, 82 pass. Further length sections of the fluid channels 81, 82 by way of example pass through the channel plate 9, wherein they run out at the carrier surface 10 such that they communicate with the length sections of the fluid channels 81, 82 which pass through the lower housing wall 88.

The two channel mouths 81*a*, 82*a* are expediently arranged distanced to one another in the longitudinal direction 19 and in particular each lie in one of the two axial end regions of the fluid chamber 5, so that the fluid covers a long as possible flow path on flowing through the fluid chamber 5, so that a uniform fluid flow is ensured.

By way of example, a delivery nozzle 91, through which the first fluid channel 81 passes and on which the delivery opening 83 is formed is attached to the channel plate 9. Furthermore, for example a connection device 92 which is assigned to the second fluid channel 82 and on which a fluid conduit 93 which forms a length section of the second fluid channel can be connected is arranged on the channel plate 9, said fluid conduit in the illustrated embodiment example leading to the shut-off unit 86.

The fluid chamber 5 does not necessarily need to communicate with two fluid channels 81, 82 for the designated use of the fluid device 1. For example, only a single fluid channel can be connected onto the fluid chamber 5, said fluid channel for its part being connected onto a further fluid channel, wherein this further fluid channel extends between the fluid source 84 and the delivery opening 83. In this case too, a sucking-back of fluid can be created by way of actuating the fluid device 1.

Figure 3:
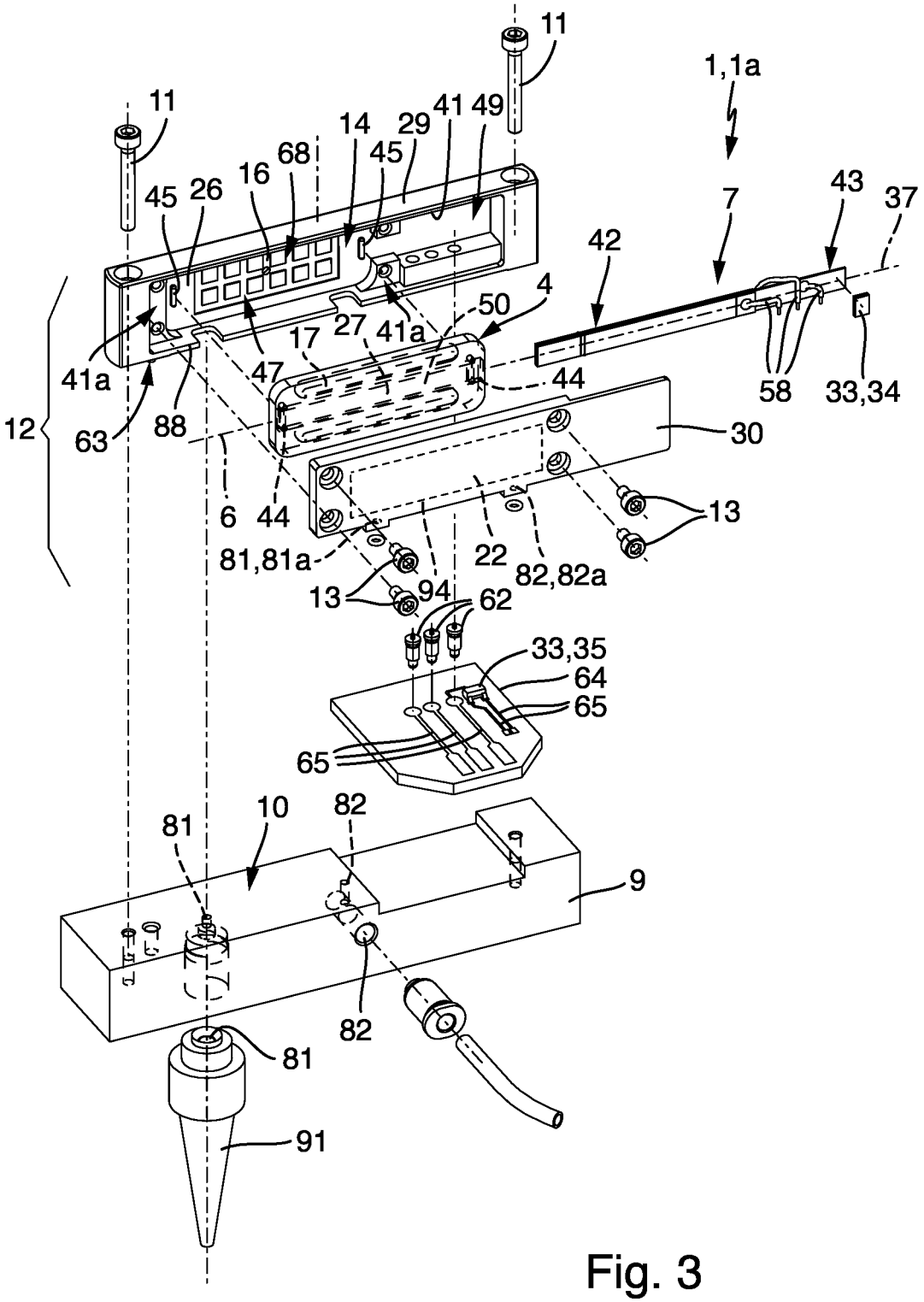

Expediently, a pressing frame 94 which is indicated in FIG. 3 in a dot-dashed manner is formed as one piece on the inner surface of the second housing part 30 which faces the fluid chamber 5, said pressing frame acting upon the peripheral edge section 17 of the membrane element 4 all around, in order to clamp this element to the first housing part 29.

Apart from the drawing back of a metered liquid, the fluid device 1 yet permits a further possibility for fluid handling. If on drawing back the liquids, it is not air which is received into the delivery nozzle 91 but a second liquid, then a through-mixing of both liquids can be carried out within the delivery nozzle 91 by way of an oscillating stroke movement of the membrane element 4, in particular if the first fluid channel 81 is formed in the delivery nozzle 01 in a stepwise manner, which given the fluid oscillation permits an better through-mixing due to the formation of turbulence at the step edges.

What is claimed is:

1. A fluid device comprising a fluid chamber which is designed for receiving a fluid and which is commonly delimited by a device housing and a bending-elastic membrane element which has a planar extension in a main extension plane, wherein the membrane element at its peripheral edge section is fixed to the device housing in a fluid-tight manner and wherein a membrane working section of the membrane element, which is framed by the peripheral edge section, for the change of the volume of the fluid chamber can be elastically deflected in a working direction which is orientated transversely to the main extension plane whilst carrying out a stroke movement, by a piezoactuator of the fluid device which acts upon the membrane element, wherein the membrane element consists of a rubber-elastic material, wherein the piezoactuator comprises a drive section which extends along the membrane working section, is embedded into the membrane element and is enveloped by the rubber-elastic material of the membrane element, and wherein the fluid device is equipped with a position detection device which is designed for the detection of a relative position between the piezoactuator and the device housing, said relative position changing given the stroke movement of the membrane working section, and wherein the piezoactuator comprises a base section which connects axially onto the drive section and in a freely ending manner projects out of the membrane element, wherein the position detection device comprises first and second detection components which cooperate with one another and of which one is arranged on the base section of the piezoactuator which carries out a pivoting movement given the stroke movement of the membrane working section, and the other is arranged in a positionally fixed manner with respect to the device housing.

2. The fluid device according to claim 1, wherein the rubber-elastic membrane element consists of an elastomer material.

3. The fluid device according to claim 1, wherein the piezoactuator is fixed to the membrane element in a manner such that the membrane element and the piezoactuator form a subassembly which can be handled as a unit.

4. The fluid device according to claim 1, wherein the drive section of the piezoactuator which is embedded into the membrane element is peripherally overmoulded by the material of the membrane element.

5. The fluid device according to claim 1, wherein the membrane element comprises an elongate receiving recess for receiving the drive section of the piezoactuator.

6. The fluid device according to claim 1, wherein the membrane element is designed in a plate-like manner.

7. The fluid device according to claim 1, wherein the membrane element in a region of its peripheral edge section has a rectangular elongate outer contour, so that it has an elongate shape which extends along an imaginary membrane longitudinal axis.

8. The fluid device according to claim 1, wherein the membrane element is arranged in the device housing as a separating wall between the fluid chamber and a breathing chamber which constantly communicates with the surroundings via at least one breathing opening.

9. The fluid device according to claim 1, wherein a housing rear wall of the device housing which lies opposite the membrane element at a side of the device housing that is opposite to the fluid chamber in the working direction, on its inner surface which faces the membrane element, and/or a rear-side membrane surface of the membrane element which faces the housing rear wall, comprises a surface structure which consists of a field of deepenings and prominences.

10. The fluid device according to claim 1, wherein the membrane element has a rear-side membrane surface which faces away from the fluid chamber and in which a groove arrangement is formed on a longitudinal side next to the drive section of the piezoactuator.

11. The fluid device according to claim 1, wherein the drive section of the piezoactuator comprises an electrode arrangement, to which an operating voltage can be applied in a variable magnitude, by way of which operating voltage a deflection movement of the drive section of the piezoactuator can be created, said deflection movement causing the stroke movement of the membrane working section.

12. The fluid device according to claim 1, wherein the piezoactuator comprises a piezoelectrically inactive carrier element, a piezoelement provided on a longitudinal side of the carrier element and an electrode of an electrode arrangement.

13. The fluid device according to claim 1, wherein the piezoactuator has a longitudinal shape.

14. The fluid device according to claim 1, wherein the piezoactuator is a piezo bending transducer.

15. The fluid device according to claim 14, wherein the drive section of the piezoactuator carries out the stroke movement of the membrane working section by executing a deflection movement.

16. The fluid device according to claim 1, wherein the piezoactuator, in the region of the peripheral edge section of the membrane element, is supported in the working direction at two locations which are distanced to one another in the main extension plane of the membrane element, by way of a rigid support structure of the device housing.

17. The fluid device according to claim 16, wherein the support structure comprises two support structures that engage into fixation recesses of the membrane element and by way of this positively fix the membrane element relative to the device housing in the main extension plane.

18. The fluid device according to claim 1, wherein the piezoactuator comprises a base section which connects axially onto the drive section and in a freely ending manner projects out of the membrane element.

19. The fluid device according to claim 1, wherein the fluid device is a fluid suction device, concerning which an underpres sure can be created by way of a volume increase of the fluid chamber which is caused by way of the piezoactuator, by way of which underpressure a fluid which is located in a first fluid channel which is connected to the fluid chamber can be sucked into the fluid chamber.

20. A fluid device comprising a fluid chamber which is designed for receiving a fluid and which is commonly delimited by a device housing and a bending-elastic membrane element which has a planar extension in a main extension plane, wherein the membrane element at its peripheral edge section is fixed to the device housing in a fluid-tight manner and wherein a membrane working section of the membrane element, which is framed by the peripheral edge section, for the change of the volume of the fluid chamber can be elastically deflected in a working direction which is orientated transversely to the main extension plane whilst carrying out a stroke movement, by a piezoactuator of the fluid device which acts upon the membrane element, wherein the membrane element consists of a rubber-elastic material, wherein the piezoactuator comprises a drive section which extends along the membrane working section, is embedded into the membrane element and is enveloped by the rubber-elastic material of the membrane element, and wherein the fluid device is a fluid suction device, concerning which an underpressure can be created by way of a volume increase of the fluid chamber which is caused by way of the piezoactuator, by way of which underpressure a fluid which is located in a first fluid channel which is connected to the fluid chamber can be sucked into the fluid chamber, and wherein a second fluid channel is additionally connected to the fluid chamber, wherein the fluid can flow into the fluid chamber through the second fluid channel and the fluid can flow out of the fluid chamber through the first fluid channel, wherein a shut-off unit is assigned to the second fluid channel, by way of which shut-off unit the second fluid channel can be shut off in order to prevent a flow of fluid into the fluid chamber through the second fluid channel, and wherein fluid which has flowed out of the fluid chamber into the first fluid channel, given the second fluid channel being shut-off by the shut-off unit can be sucked back into the fluid chamber by way of creating the underpressure in the fluid chamber.

21. The fluid device according to claim 20, wherein the fluid device is equipped with a position detection device which is designed for the detection of a relative position between the piezoactuator and the device housing, said relative position changing given the stroke movement of the membrane working section.

22. The fluid device according to claim 21, wherein the piezoactuator comprises a base section which connects axially onto the drive section and in a freely ending manner projects out of the membrane element, wherein the position detection device comprises first and second detection components which cooperate with one another and of which one is arranged on the base section of the piezoactuator which carries out a pivoting movement given the stroke movement of the membrane working section, and the other is arranged in a positionally fixed manner with respect to the device housing.

* * * * *